United States Patent [19]

Hennig

[11] Patent Number: 4,512,379

[45] Date of Patent: Apr. 23, 1985

[54] SPOUT FOR LIQUID PACKING APPARATUS

[75] Inventor: Franz Hennig, Düsseldorf, Fed. Rep. of Germany

[73] Assignee: Jagenberg AG, Düsseldorf, Fed. Rep. of Germany

[21] Appl. No.: 404,089

[22] Filed: Aug. 2, 1982

[30] Foreign Application Priority Data

Aug. 28, 1981 [DE] Fed. Rep. of Germany ..... 3134182

[51] Int. Cl.[3] ..... B65B 3/04

[52] U.S. Cl. ..... 141/286; 141/392; 222/575; 239/590.3

[58] Field of Search ..... 141/285–310, 141/392, 1–12, 250–284; 239/548–568, 590.3; 222/575

[56] References Cited

U.S. PATENT DOCUMENTS

| | | | |
|---|---|---|---|
| 1,865,227 | 6/1932 | Arzino | 141/286 |
| 2,334,802 | 11/1943 | Zuckermann | 239/590.3 |
| 2,551,699 | 5/1951 | Parks | 239/590.3 |
| 2,681,696 | 6/1954 | Stalego | 239/590.3 |
| 2,775,486 | 12/1956 | King | 239/590.3 |
| 2,867,247 | 1/1959 | Aldridge | 141/286 |

FOREIGN PATENT DOCUMENTS 13132 7/1980 European Pat. Off. .

*Primary Examiner*—Houston S. Bell, Jr.

*Attorney, Agent, or Firm*—Sprung, Horn, Kramer & Woods

[57] ABSTRACT

In a machine for filling containers with liquid including a spout plate provided with bores for the passage of liquid, means for delivering liquid to the spout plate and means for closing off the bores of the spout plate so as to discontinue passage of liquid through the spout plate, the improvement which comprises employing as said spout plate a plate provided with at least one field of bores extending therethrough and on its bottom with a lip about a least part of the field and projecting into the path of streams of liquid issuing from the marginal bores of each field, whereby the marginal streams of liquid are forced to join with other liquid streams for minimized foaming during filling.

7 Claims, 7 Drawing Figures

SPOUT FOR LIQUID PACKING APPARATUS

BACKGROUND

The invention relates to a spout on filling apparatus for packing liquids, having a spout plate which has a plurality of bores disposed closely side by side for the passage of the liquid into a container or the like disposed underneath the spout.

The spouts on packing apparatus of the kind herein contemplated are commonly operated cyclically, so that the material being packed, such as milk or fruit juice, can be poured intermittently into the containers moved successively and cyclically under the spout. Operation at maximum speed in the sense of short cycling times requires that the stream emerging from the spout be made as large as possible in relation to the container cross section, which in turn requires that the filling stream be given a precise shape with a smooth outside surface. The intermittent manner of operation furthermore necessitates measures for preventing the liquid from dripping between fill cycles, in order to prevent contamination of the apparatus and trouble in closing the containers such as might be caused by wetting them with the liquid in the area of the closure. For the achievement of this purpose in the spouts it is known to dispose strainer or filter disks in the spouts, or else spout plates having bores disposed closely adjacent one another. The invention relates to this last-described type of spouts. This type has the advantage over the use of strainer and filter disks, which cannot be used with pulpy liquids, of a wider range of applications. However, the known spouts of this kind are not free from disadvantages, either. For example, the individual bores in the spout plate result in a great number of individual jets having a relatively large total surface area, resulting in severe frothing. The froth on the surface of the material in the filled container is disadvantageous for the reason that it can again cause wetting in the container areas which have to be heated afterward for closing by heat sealing or the like. The larger surface area of the many individual jets, however, also causes fine air bubbles to be entrained in the liquid, which initially do not immediately manifest themselves in froth, but do raise the liquid level and thus also cause difficulty in closing.

It is already known to dispose the bores in the spout plate at a low angle to the axis of the spout, or to set the container at an angle underneath the spout, so that the liquid jets emerging from the bores impinge upon the inside wall of the container at an angle, and the liquid flows down this wall in the form of a film (cf. European patent application No. 00 13132). In this manner a certain improvement can be achieved as regards foaming and the entrainment of air into the liquid, but it does not go all the way, for the problem still persists of the dripping of the liquid between the individual container filling cycles.

THE INVENTION

It is therefore the object of the invention to design a spout of the kind described above such that a sharply defined, largely solid filling stream will be formed whereby the entrainment of air, which can lead to foaming and an undesirable raising of the fill level, will be reduced, and dripping between successive filling cycles will not occur.

This problem is solved in accordance with the invention by the fact that the bore orifices at the bottom of the spout plate are arranged in one or more fields, and that at the margin of each field, lips projecting from the bottom of the spout plate are formed which extend into the stream cross sections of the marginal bore orifices of each field.

The lips, which, depending on the shape of the field or fields, can also be formed by a single circumferential lip, extend into the cross sections of the jets emerging from the bore orifices situated along the margins of the fields and deflect them toward the center of the field. This causes a convergence of the individual jets to form a single stream corresponding in cross-sectional shape to the shape of the field. By this means, a relatively great number of bores of small diameter can be provided without having to accept a disadvantage in regard to frothing or the entrainment of air. Particularly good conditions are obtained when the total cross section of the bores of each field is in a ratio of approximately 1:1.5 to the cross section determining the stream cross section. In this case, the above-mentioned convergence of the individual liquid jets emerging from the bore orifices into the solid stream takes place, but at the same time the spaces between the bore orifices are filled by the liquid, so that the enlargement of cross-sectional area resulting therefrom produces a reduction of the velocity of flow.

Furthermore, after the end of the container filling cycle, i.e., when the pumping pressure drops, the relatively small bores hold back the liquid column remaining in and above the bore orifices, so that dripping can be reliably prevented. Liquid present outside of the bore orifices between the bottom of the spout plate and the projecting lips is retained by the space between them. This action is further improved if, in accordance with an advantageous development of the invention, the lips converge toward the stream line of the bores into whose cross section they project, i.e., if they are at an angle to the center line of the fill stream that is formed. It is desirable to select this sloping arrangement of the lips such that the space situated between the bottom of the spout plate and the lips, in which residual liquid is retained and prevented from dripping, is accessible for a reliable cleaning by the circulatory method.

In an arrangement of the bores in a plurality of fields to form an appropriate number of solid filling jets, each field is surrounded by a lip. In the filling of rectangular or square containers, in which case the bores are arranged in elongated rectangular fields, the lips at the bottom of the spout plate form narrow slits of corresponding size.

According to another advantageous development of the invention, provision is made such that in each field the bottom of the spout plate projects locally downwardly, and the projection tapers to a point or edge situated centrally between the lips on opposite sides of the field. Also this projection, which ought not to project as far as the lips do, promotes the consolidation of the individual jets into a single filling jet.

To special advantage the above-described configuration of the spout plate can be combined with an angular disposition of the bores in the spout plate. In this case the bores are at a low angle to the longitudinal axis of the spout such that the solid jet formed by the consolidation, or the plurality of jets formed by a plurality of fields as the case may be, will strike the inner wall of the container at an angle. If the slanting bores are arranged in a plurality of fields, it is advantageous to adapt these fields to a certain extent to the cross-sectional profile of the container that is to be filled. For example, for the filling of containers of rectangular or square cross section, the bores can be arranged in a plurality of narrow rectangular fields which are disposed parallel to the sides of the container cross section or at least to two opposite sides thereof, the spout bores in either one of each pair of fields being divergent in the direction of flow from those of the opposite field.

The retention of the liquid column within the bores and above their orifices can be still further improved according to a further development of the invention by reducing the bores to a smaller diameter just upstream of their discharge orifice. Dripping between the individual filling cycles can even be prevented in this manner, even in the case of a relatively great angle of inclination of the bores from the longitudinal axis of the fill spout.

The invention will now be further explained with the aid of embodiments in conjunction with the appended drawings, wherein.

Figure 1:
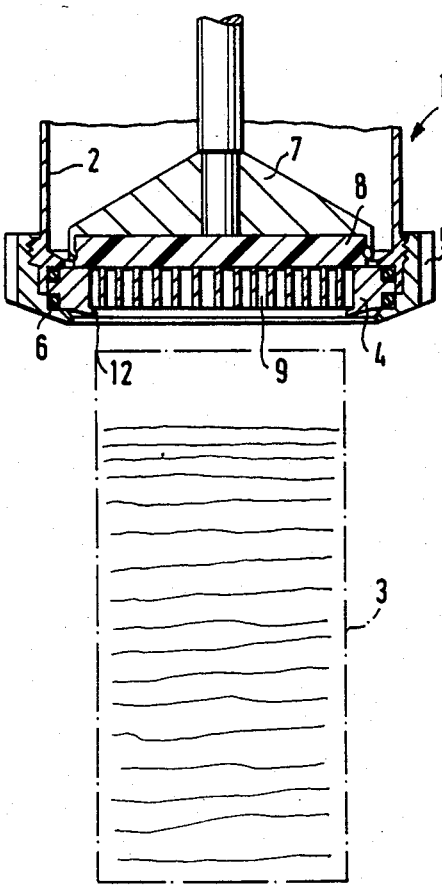
FIG. 1 is a longitudinal section along line I—I in FIG. 2 through the bottom end of a fill spout.

The fill spout, designated generally by the number 1, consists essentially of a tubular part 2, which, in a manner not represented in detail, is disposed in a filling machine, for milk, for example, and is connected to appropriate supply lines. With the fill spout there is associated, in a manner known in itself, a metering apparatus, not shown, by which a predetermined amount of liquid is delivered and can be poured through the fill spout into a container 3 introduced thereunder.

At the bottom end of the tubular part 2 there is disposed a spout plate 4 which is held by a threaded ring 5 on the tubular part 2, and is sealed at its circumference by sealing rings 6. Above the spout plate 4 there is disposed a valve body indicated by the number 7, which is controlled by the metering apparatus, not shown, and which can be raised and lowered and has at its bottom a sealing element 8. Between the filling cycles, the valve body 7 rests with sealing element 8 on the top of the spout plate 4 and thus closes the end of the fill spout 1.

Figure 3:
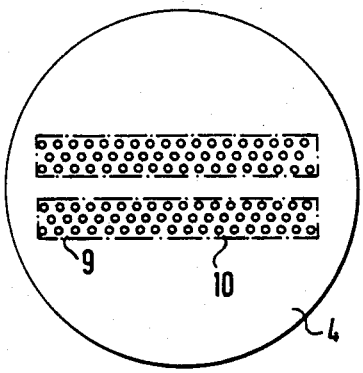
FIG. 3 is a top view of the spout plate used in the fill spout of FIGS. 1 and 2.

The spout plate 4, which for example can have a diameter of 120 mm and a thickness of about 15 mm, has spout bores 9 which are combined into groups in two parallel fields 10 (cf. FIG. 3). The two fields 10 are disposed in symmetry with a diametral plane of the spout plate 4, which contains the longitudinal axis 3' of the container and is parallel to the two long sides of the rectangular cross section of the container. The fields 10 have a narrow, rectangular form, rounded off at their extremities if desired, and they are disposed in parallel rows; the length of the fields 10 corresponds approximately to the length of the rectangular cross section of the container 3 (cf. FIG. 1).

Figure 2:
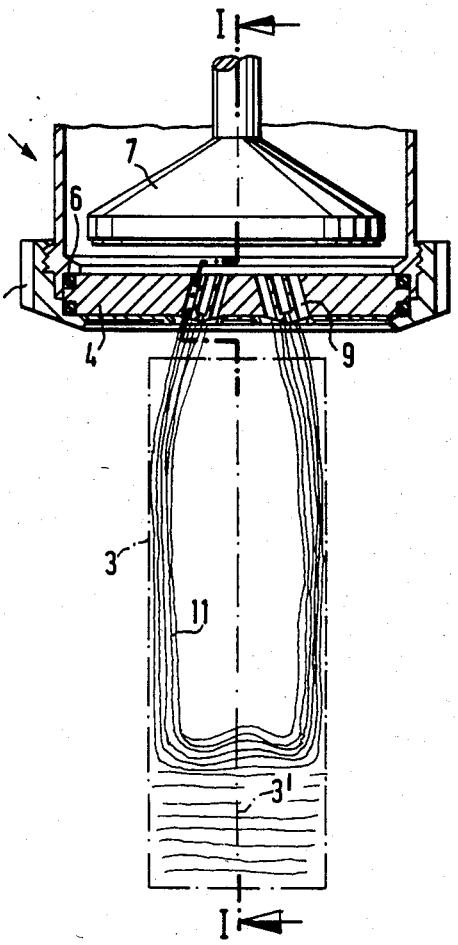
FIG. 2 is a similar longitudinal section turned at 90°.
Figure 5:
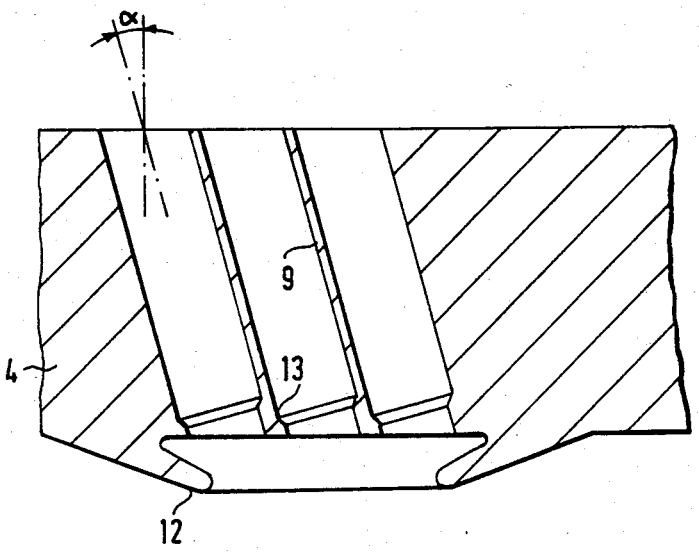
FIG. 5 is an enlarged fragmentary cross section on line V—V of FIG. 4.

The spout bores 9 are, as indicated in FIGS. 2 and 5, disposed at a low angle $\alpha$ to the longitudinal axis of the spout 1, which is such that, taking into account the pumping pressure used in the filling operation, the liquid jets flowing from the spout bores 9 flow against the inner sides of the container 3, so that the liquid flows downwardly on the inside of the container walls in the form of a film or curtain 11. The spout bores 9 of the one field 10 are divergent from the spout bores of the other field (FIG. 2), so that two fill jets are formed, which strike the opposite walls of the container 3. The individual spout bores 9 within each field 10 are best made parallel to one another.

Figure 4:
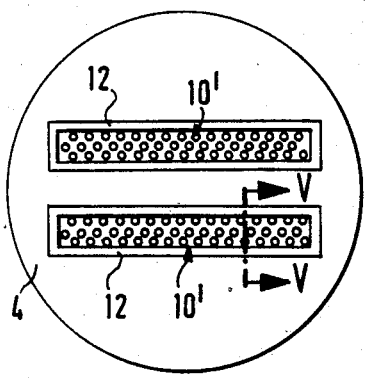
FIG. 4 is a bottom view of the spout plate of FIG. 3.

The spout bores 9, as disposed in fields 10, have their orifices on the bottom of the spout plate 4. The fields 10' there formed (see FIG. 4) are each surrounded on all sides by a downwardly tapering and projecting lip 12 made integral with the spout plate 4 (see FIG. 5) and converging toward the stream line formed by the longitudinal axes of the spout bores 9. The lip 12 projects, as seen in FIG. 5, into the stream cross section of the spout bores 9 situated closest to the margin of the fields 10'. As a result, the jets of liquid emerging from these spout bores are deflected towards the center of the fields and thus produce a confluence, consolidating the individual jets into a single filling jet in each field.

As it appears from FIG. 5, the spout bores 9 are constricted shortly ahead of their orifice at the bottom of the spout plate 4 to a smaller diameter, thereby forming a shoulder 13. This enhances the ability of the spout bores 9 to retain the residual liquid still contained in the spout bores 9 after the filling cycle has ended, without letting it drip. As a result of the short distance between the lip 12 and the bottom of the spout plate 4, residual liquid is reliably retained even at the angle that can be seen in FIG. 5.

The configuration having the shoulders 13 shortly ahead of the orifice of the spout bores 9 combined with the lip 12 results in solid fill jets of rectangular shape whose profile corresponds to that of the fields 10'. On account of the selected bore size, both clear liquids of low surface tension and pulpy liquids as well can be packed in the containers 3 without the need to change the spout plate 4. It is obvious that the total bore area is selected such that the pumping pressure built up by the metering apparatus, which is not shown, is sufficient to assure that the liquid will flow through all of the spout bores 9. The features described also assure a clean interruption of the fill jets and retention of the residual liquid after metering has ended.

Figure 6:
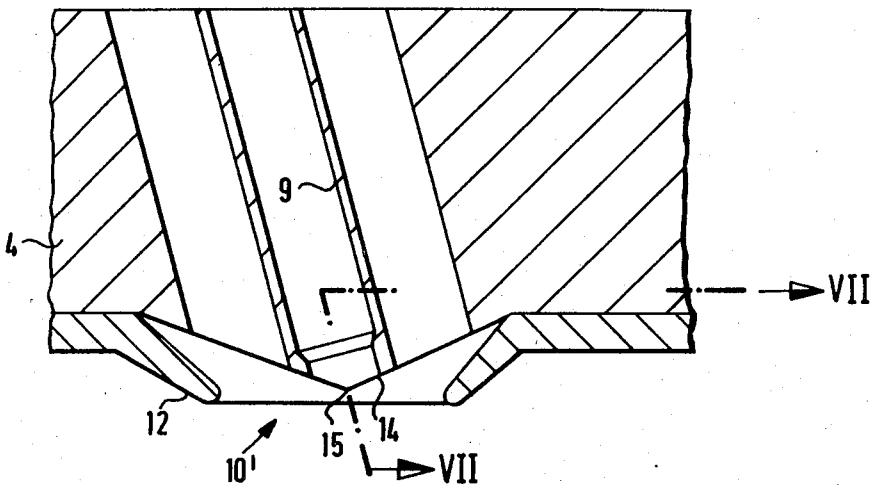
FIG. 6 is a cross section similar to FIG. 5, taken through a modified embodiment.
Figure 7:
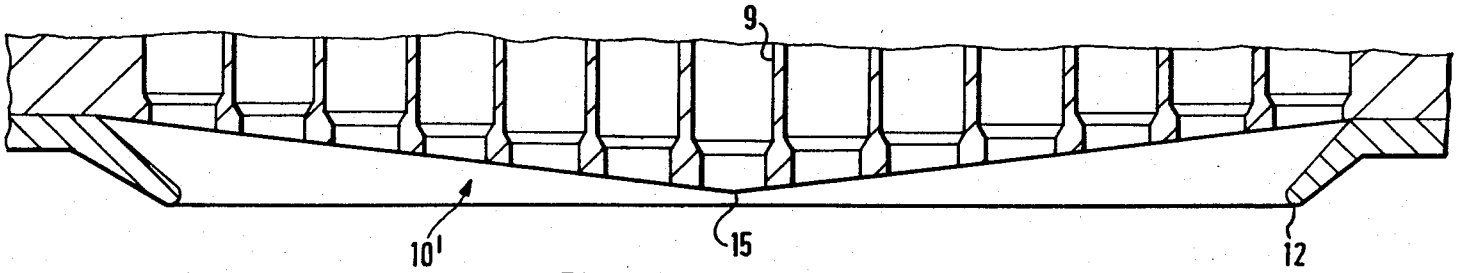
FIG. 7 is a fragmentary cross section along line VII—VII of FIG. 6, in which not all of the spout bores are shown, for reasons of simplification.

In the embodiment represented in FIGS. 6 and 7, the bottom of the spout plate 4 is drawn downardly in the area of the field 10' surrounded by the lip 12 from the margins of the field 10' such that a ridge-like projection 14 is produced which is of pyramidal shape. The apex 15 formed by the projection 14 lies approximately centrally between the opposite sections of the lip 12; the diagonals of the base of the pyramid are parallel to the sides of the field 10'.

From FIG. 6 is it also apparent that only the bores 9 of the center row of bores are constricted to form a shoulder 13 ahead of their orifice, while the two adjacent rows of bores have plain bores.

By the combination of the above-described lip configuration on the bottom of the spout plate 4 with the angling of the spout bores 9 it is possible without any great cost or difficulty to greatly reduce frothing and the entrainment of air into the liquid and to avoid dripping between the individual fill cycles.

It is evident that the shape given to the fields 10 and 10' in the present embodiment is not obligatory. For example, it is conceivable in the case of containers of square cross section to construct four fields arranged to correspond to the cross-sectional profile of the containers so that jets are directed against all four of the inside walls of each container. In the case of containers of round cross section, a corresponding curvature of the fields is conceivable.

In the embodiment (cf. FIGS. 3 and 4) the spout bores 9 are disposed in parallel rows, while the bores of each row are offset from those of the other. In this manner a great number of spout bores can be contained in a minimum of space. The effect striven for by the invention, however, is always achieved even if the spout bores are arranged in rows which are parallel in two directions perpendicular to one another.

The lips surrounding the fields containing the spout bores can be integral with the spout plate (cf. FIG. 5), in which case they can be made by the electro-erosion process or by casting. It is desirable, however, to provide the lips on a separate component (cf. FIG. 6), which covers the bottom of the spout plate.

It will be appreciated that the instant specification and examples are set forth by way of illustration and not limitation, and that various modifications and changes may be made without departing from the spirit and scope of the present invention.

I claim:

1. A spout plate, for filling a container with a liquid, provided with several narrow rectangular fields of bores extending therethrough, the bores being arranged symmetrically about a central axis, the bores in a first field in the direction of discharge diverging from the bores in a second field lying opposite the first field with respect to said central axis, each bore immediately upstream of its exit orifice being reduced to a lesser diameter to form a shoulder, the bores being inclined at an acute angle to the longitudinal axis of the spout such that liquid streams emerging from the bores are aimed at an angle toward the container inner wall, the plate on its bottom having integral lips about at least part of each field and projecting into the path of streams of liquid issuing from the marginal bores of each field, whereby the marginal streams of liquid are forced to join with other liquid streams for minimized foaming during filling, the bottom of the spout plate at each field being formed into a projection which tapers downwardly to a point or edge, and which projects less far than the lip.

2. A spout plate according to claim 1, wherein a lip substantially surrounds each field of bores, the lip projecting downwardly and toward the field.

3. A spout plate according to claim 2, wherein the total cross sectional area of the bores of each field is from about 1 to 1.5 times the minimum area encompassed by the lip.

4. A spout plate according to claim 1, wherein the fields in the spout plate conform to the shape of the spout plate.

5. A spout plate according to claim 1, wherein the bores in each field are arranged offset from one another in parallel rows.

6. A spout plate according to claim 1, wherein the ratio of the bore length to the bore diameter amounts to at least 3:1.

7. In a machine for filling containers with liquid including a spout plate provided with bores for the passage of liquid, means for delivering liquid to the spout plate and means for closing off the bores of the spout plate so as to discontinue passage of liquid through the spout plate, the improvement which comprises employing as said spout plate a plate according to claim 1.

* * * * *